US007131305B2

(12) United States Patent
Desousa et al.

(10) Patent No.: US 7,131,305 B2
(45) Date of Patent: Nov. 7, 2006

(54) METHOD AND APPARATUS FOR LEAN SPIN FORMING

(75) Inventors: Egas Jose Desousa, Grand Blanc, MI (US); John C. Boehnke, Grand Blanc, MI (US); James M. Ciosek, Davison, MI (US); Frederick D. Wagner, Grand Blanc, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/687,724

(22) Filed: Oct. 17, 2003

(65) Prior Publication Data

US 2005/0081590 A1 Apr. 21, 2005

(51) Int. Cl.
*B21D 3/02* (2006.01)

(52) U.S. Cl. ..... 72/121; 72/84; 72/125

(58) Field of Classification Search ..... 72/82, 72/83, 84, 85, 94, 101, 120, 121, 125, 370.24, 72/370.25, 441, 447; 29/890
See application file for complete search history.

(56) References Cited

U.S. PATENT DOCUMENTS 5,937,516 A * 8/1999 De Sousa et al. ..... 29/890
6,216,512 B1 * 4/2001 Irie ..... 72/121
6,591,498 B1 * 7/2003 Irie et al. ..... 29/890
6,769,281 B1 * 8/2004 Irie et al. ..... 72/121
6,823,704 B1 * 11/2004 Nakamura et al. ..... 72/121

FOREIGN PATENT DOCUMENTS

WO 02/07906 * 1/2002
WO 02/062500 * 8/2002

* cited by examiner

*Primary Examiner*—Ed Tolan
(74) *Attorney, Agent, or Firm*—Paul L. Marshall

(57) ABSTRACT

A method and apparatus for spin forming a portion of a workpiece includes at least two rollers rotatable about a spin axis. Each one of the rollers is axially and radially offset from the others. An axial drive mechanism reciprocates the rollers or workpiece to causes the first roller and then the second roller to sequentially engage the workpiece. A higher reduction ratio is achieved which enables improved efficiency. The present invention reduces floor space requirements as the forming operation may be completed on a single machine.

19 Claims, 9 Drawing Sheets

METHOD AND APPARATUS FOR LEAN SPIN FORMING

FIELD OF THE INVENTION

The present invention relates to an apparatus and method for spin forming a workpiece. More specifically, the invention relates to a multiple step reduction forming pass, multiple cycle apparatus and method of spin forming a workpiece.

BACKGROUND OF THE INVENTION

Many processes are available for manufacturing a tubular workpiece having a circular, oval or otherwise hollow cross section with a transition portion. Applications for these components include catalytic converter housings used in automotive exhaust systems. In the prior art, these components were usually made from several pieces, such as a pair of clam shells or a tubular section and formed end pieces joined by non-sophisticated techniques, such as resistance, TIG or MIG welding. However, welding these components together is not desirable because of durability concerns.

Other known processes for forming a transition portion on a work piece include forming techniques. One such technique is a ram forming process. However, ram forming has limitations regarding diameter reduction ratios. Another known process is spin forming, one example of an apparatus for spin forming is shown in FIGS. 1–4. A spin forming apparatus 1 of the prior art includes a plurality of rollers 3 supported by a rotatable carrier 2. Each roller 3 has a tapered face 4. The rollers 3 reduce the original diameter 12 of workpiece 6 to a reduced diameter 8. A mandrel 5 provides internal support to the workpiece 6 during a spin forming operation. Although the prior art spin forming apparatus disclosed in FIGS. 1–4 is effective for creating a transition portion on a workpiece, there are a number of shortcomings associated with the apparatus 1.

One shortcoming of apparatus 1 is the reduction ratio, the ratio of the original diameter to the reduced diameter, that can be achieved. Exceeding the reduction ratio limitation will collapse the reduced portion of the workpiece, resulting in scrap. The amount of reduction available for apparatus 1 is limited by the reduction ratio.

Another limitation inherent in apparatus 1 is multiple machines are required to achieve a desired reduction in diameter if multiple passes are required for additional reduction in diameter beyond the limitations of the reduction ratio for apparatus 1. Accordingly, the workpiece must be transferred from one machine to another machine that has rollers that are arranged in a smaller diameter to further reduce the diameter of a portion of a workpiece. The workpiece continues to be transferred to another machine having a smaller diameter yet, until the desired diameter is achieved. As a result, additional machines, or stations, are required as well as additional floor space. Furthermore, a significant amount of time is required to reduce a portion of the workpiece.

Other spin forming machines have rollers that are inwardly adjustable to permit multiple passes on a work piece by a single machine. This solution may eliminate the need for multiple machines to reduce the diameter of a single workpiece; however, these machines still have limitations in the reduction ratio for a single forming pass. Therefore, several passes are required to achieve a desired reduction in diameter of a workpiece. For example, 21 passes are typically required to reduce a portion of a workpiece from a 4 inch diameter to a 2 inch diameter. Although spin forming machines that have inwardly adjustable rollers respond to the concerns of floor space usage and multiple stations, these spin forming machines are still not efficient enough.

Referring now to FIG. 5, an improved spin forming apparatus 9 according to the prior art is shown. The apparatus 9 includes a plurality of rollers 11 operatively supported by a rotatably supported carrier 10. Each of the rollers 11 is radially and axially offset from the other rollers 11. The axial and radial offset of the rollers 11 allows the apparatus 9 to make multiple reductions in a single forming pass, resulting in a superior reduction ratio for a work piece. As workpiece 6 and rollers 11 are engaged, the one of the rollers 11 furthest from the carrier 10 will contact the workpiece 6 first. As the rollers 11 and workpiece 6 are further engaged, the next one of the rollers 11 closest to the carrier 10 will contact the workpiece 6, further reducing the workpiece 6. This process continues until the workpiece 6 and rollers 11 are completely engaged. Apparatus 9 provides a favorable reduction ratio and an improved forming time, however, multiple stations are still required, as apparatus 9 is limited by the number of rollers that may be mounted on the carrier 10. As an example, four stations would be required to reduce a workpiece from a 4 inch diameter to a 2 inch diameter by employing apparatus 9.

Therefore, there exists a need for a spin forming process and machine that does not require multiple stations. There further exists a need for a spin forming machine and process that has an improved efficiency.

Thus, it is desirable to provide a method and apparatus for spin forming a workpiece that has an improved efficiency while capable of completing a forming operation on a single machine.

SUMMARY OF THE INVENTION

An apparatus for spin forming a portion of a workpiece comprises a carrier rotatable about a spin axis. At least a first roller and a second roller are operatively supported on the carrier. The first roller is radially and axially offset from the second roller. The first and second rollers are radially movable toward and away from the spin axis. A rotational drive mechanism spins the carrier about a spin axis. A radial drive mechanism radially translates the first roller and the second roller toward and away from the spin axis to position the rollers for a forming pass. An axial drive mechanism reciprocates one of either the first and second rollers or the workpiece along a spin axis to sequentially engage the first roller and then the second roller to a first end of the workpiece where the first roller and the second roller sequentially reduce the diameter of portion of the workpiece during a forming pass. The axial drive mechanism may continue to reciprocate until a desired reduction in diameter is achieved. The workpiece may be reduced from an original diameter to final diameter on a single apparatus.

The first roller and the second roller sequentially reduce the diameter of a portion of workpiece to achieve a desired diameter with a minimum number of forming passes. The first roller reduces the diameter of a portion of the workpiece from a first diameter to second diameter and the second roller reduces the diameter of a portion of the workpiece from the second diameter to third diameter. The change in diameter between the first diameter and second diameter is about equivalent to change in diameter between the second diameter in third diameter. The amount of reduction in a single forming pass is a function of the number of rollers.

The radial drive mechanism positions the first and second rollers before the axial drive mechanism sequentially engages the first roller and then the second roller to a first end of the workpiece. After a first forming pass, the radial drive mechanism radially translates the first roller from a first radial distance to third radial distance, relative to the spin axis, where the first radial distance is greater than the third radial distance, and second roller from a second radial distance to fourth radial distance, relative to the spin axis, the second radial distance is greater than the fourth radial distance. The radial drive mechanism may translate the rollers in unison. The radial drive mechanism may further cause the first roller and the second roller to radially translate inward by an equivalent radial distance prior to a subsequent forming pass. The rollers may translate inwardly in calculated steps. Furthermore, the rollers may radially translate in unison.

A fixture is provided for constraining the workpiece. The fixture may be aligned to position the workpiece so that the axis of the non-processed portion of the workpiece is at an oblique angle relative to the spin axis. The radial drive mechanism may be an internal actuation device, where the drive elements for radially translating the rollers are located within a shaft that rotates the carrier. Alternatively, the radial drive mechanism may be an external actuation device, where the drive elements for radially translating the rollers are located external to a shaft that rotates the carrier. Accordingly, the radial drive mechanism is operable to translate the first roller and the second roller while the rotational drive mechanism spins the carrier.

A method of spin forming a portion of a workpiece comprises spinning at least a first roller and the second roller about a spin axis where the first roller is radially and axially offset from the second roller. The first roller and second roller are commanded to translate radially to position the rollers for a forming pass. A forming pass is commanded to cause one of the rollers or workpiece to travel along the spin axis to engage the first roller and then the second roller to a first end of the workpiece to sequentially reduce the diameter of a portion of the workpiece to create a formed portion. The workpiece may be positioned for forming whereby the axis of the unprocessed portion of the workpiece is at an oblique angle relative to the spin axis.

The diameter of a portion of the workpiece is sequentially reduced until a desired diameter is achieved. The diameter of a portion of the workpiece is sequentially reduced by a plurality of forming passes during a forming operation. The rollers are commanded to radially translate toward the spin axis by calculated steps before a forming pass. The amount of reduction in a single forming operation is a function of the number of rollers. The portion of the workpiece is reduced from an original diameter to final diameter on a single device. The rollers are commanded to spin while commanded to radially translate.

Further objects, features and advantages of the present invention will become apparent to those skilled in the art from analysis of the following written description, the accompanying drawings and the appended claims.

DESCRIPTION OF THE PREFERRED EMBODIMENT

Figure 2:
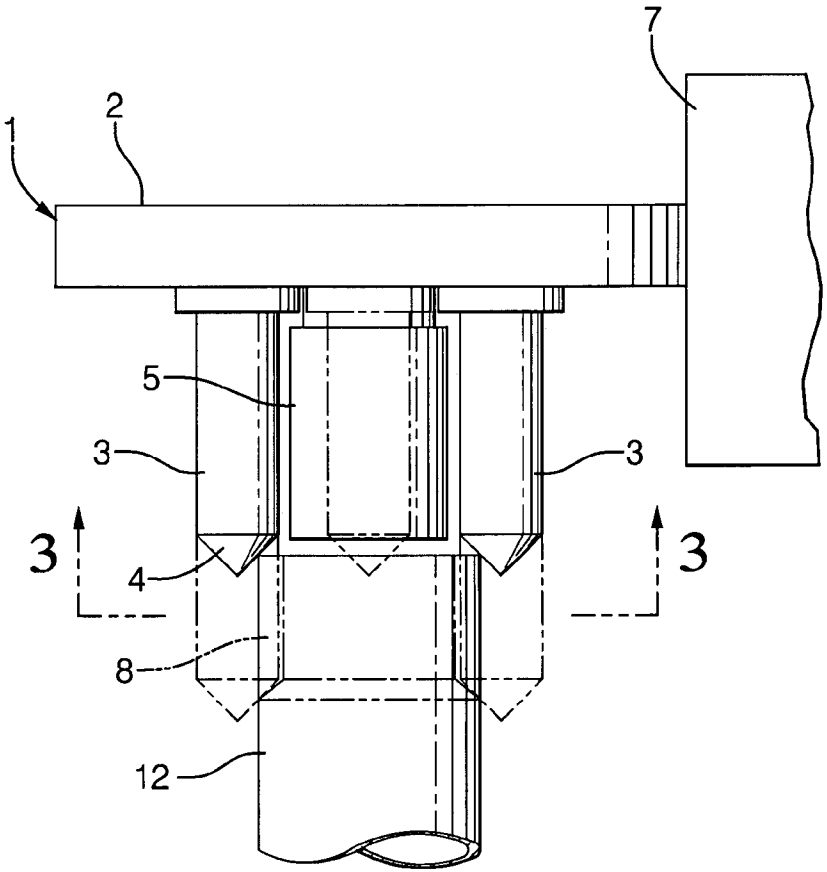
PRIOR ART FIG. 2
FIG. 2 is an illustration of the prior art spin forming apparatus in FIG. 1, further revealing the rollers fully engaged on a workpiece.
Figure 1:
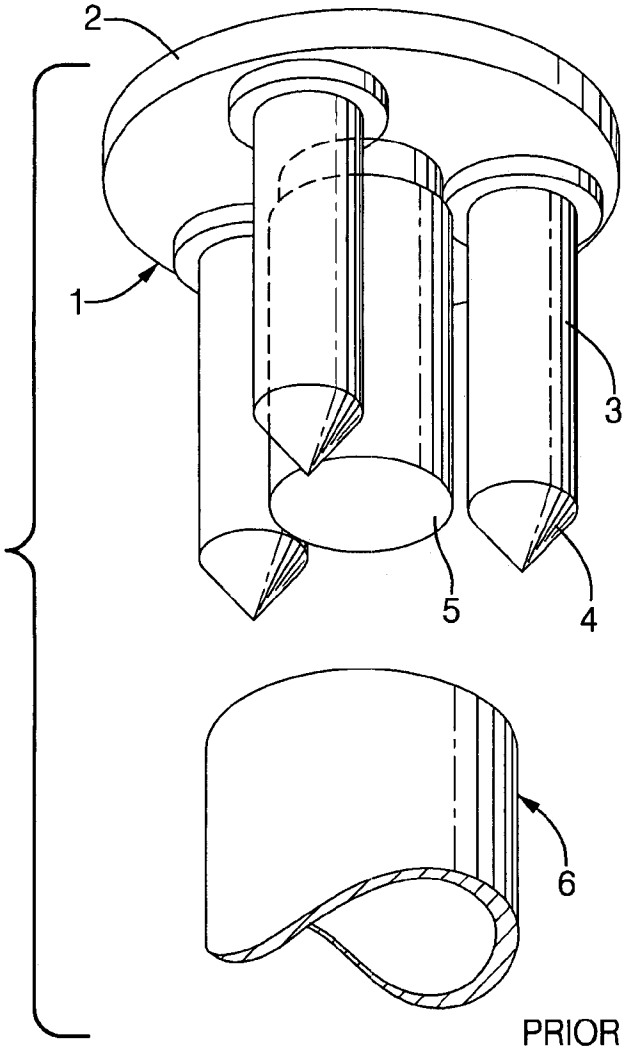
PRIOR ART FIG. 1
FIG. 1 is an illustration of a prior art spin forming apparatus.
Figure 5:
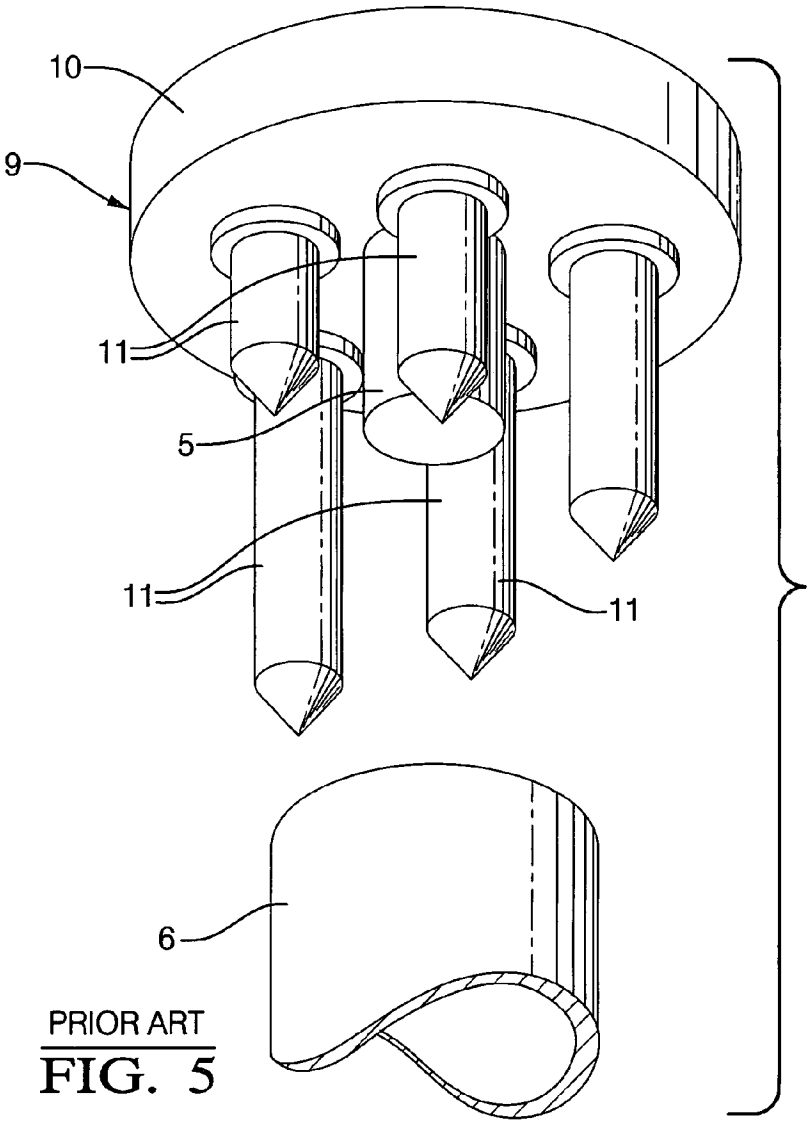
PRIOR ART FIG. 5
FIG. 5 is another prior art spin forming apparatus, revealing a plurality of rollers having different axial positions and radial positions.
Figure 3:
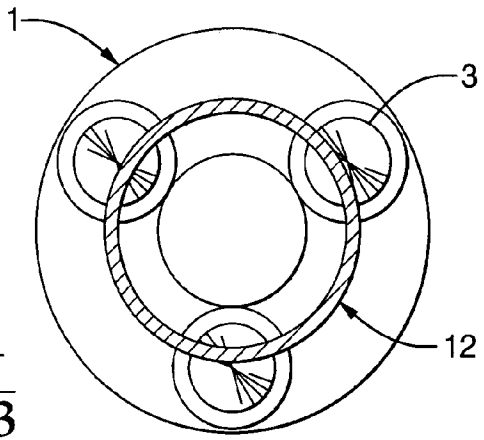
PRIOR ART FIG. 3
FIG. 3 is a cross sectional view of a portion of a workpiece to be formed prior to engaging the rollers of the prior art spin forming apparatus in FIG. 1.
Figure 4:
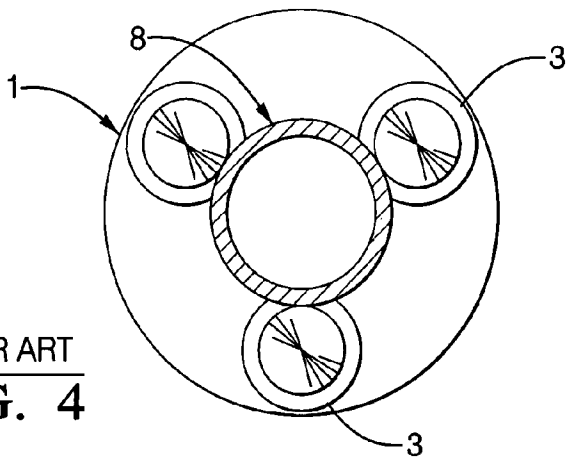
PRIOR ART FIG. 4
FIG. 4 is a cross sectional view of a portion of a workpiece formed by the rollers of the prior art spin forming apparatus in FIG. 1.
Figure 6:
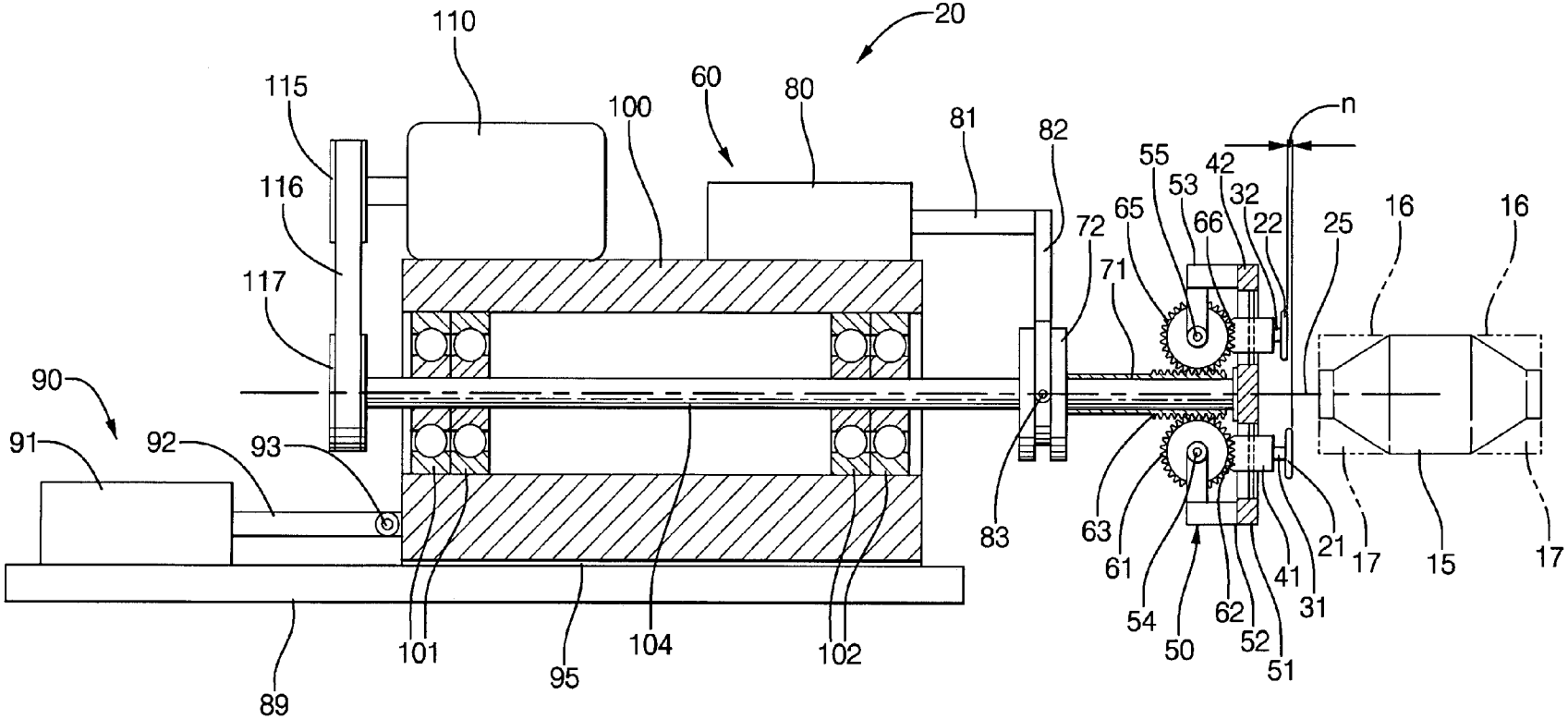
FIG. 6 is a side view of a first embodiment of the spin forming apparatus according to the principles of the present invention, having a portion thereof sectioned.

With initial reference to FIG. 6, a side view of a first embodiment of a spin forming apparatus 20 according to the principles of the present invention is shown. The apparatus 20 comprises a rotational drive mechanism 100, which in the present embodiment, includes a drive shaft 104 that is rotatably supported in a case 95 by two pairs of bearing elements 101, 102. The case 95 is slidably supported on a machine base 89. A motor 110 for driving the shaft 104 is fixedly mounted to the case 95. In the preferred embodiment, the motor 110 is an electric motor, however those skilled in the art will immediately recognize that any rotary actuator may be substituted for an electric motor. Power from the motor 110 is transferred from a pulley 115 secured to an output shaft of the motor 110 through a drive belt 116 to a pulley 117 secured to the drive shaft 104. Drive shaft 104 is coupled to a carrier 50 that is rotatable about a spin axis 25. Although a belt and pulley drive system is disclosed, any suitable substitute may be employed, including, but not limited to, a chain driven system or shaft driven system.

When the rotational drive mechanism 100 receives a command to spin the carrier 50 about the spin axis 25, the motor 110 spins pulley 115, causing drive belt 116 to spin pulley 117. Pulley 117 spins the drive shaft 104 and carrier 50.

Carrier 50 includes a carrier housing 53 and a faceplate 52 At least a first roller 21 and second roller 22 are operatively supported on the carrier 50 by bearing blocks 41 and 42 through shafts 31 and 32, respectively. Roller 21 is axially offset from roller 22 by a distance n. Roller 21 is also radially offset from roller 22. In the present embodiment, roller 21 is disposed at a first axial position and roller 22 is disposed at a second axial position, where the first axial position is further from the faceplate 52 than the second axial position. Roller 21 is disposed at a first radial position and roller 22 is disposed at a second radial position, where the first radial position is further from the spin axis 25 than the second radial position. In the preferred embodiment, the rollers 21, 22 are axially and radially offset by 1 mm. However, those skilled in the art will immediately recognize that factors such as heating the workpiece, the workpiece material, and feed rate, among others, will affect the optimal offset. Although two rollers are disclosed in the present embodiment, those skilled in the art will immediately recognize that three or more rollers may be employed by the spin forming apparatus 20 of the present invention. As the rotational drive mechanism 100 rotates the carrier 50, the rollers 21, 22 spin about the spin axis 25.

The rollers 21, 22 are radially movable toward and away from the spin axis 25 by a radial drive mechanism 60. Radial drive mechanism 60 includes an actuator 80 fixedly mounted to the case 95. In the preferred embodiment, actuator 80 is a programmable linear actuator; however, those skilled in the art will immediately recognize that any suitable substitute may be employed. The actuator 80 controls the position of a rod 81, which extends therefrom. The rod 81 is fixedly attached to a lever 82 at a first end. The second end of lever 82 cooperates with a yoke 72. The yoke 72 is fixedly attached to a hollow shaft 71.

Drive shaft 104 extends through, and rotates relative to, hollow shaft 71. Hollow shaft 71 has an inner diameter that is sufficient to provide a clearance condition with drive shaft 104. Hollow shaft 71 has a toothed portion 63 on the outside of the shaft. A pair of gears 61, 65 are rotatably supported by the carrier housing 53 and mesh with the toothed portion 63 of hollow shaft 71. Bearing blocks 41 and 42 have racks 62 and 66 and also mesh with gears 61, 65, respectively. The faceplate 52 has a plurality of radially extending channels 51 to guide bearing blocks 41, 42. In the present embodiment, the faceplate 52 has two channels 51, with each channel dedicated to a bearing block. In the preferred embodiment, the bearing block and channel combination is an L-gib slide.

When the radial drive mechanism 60 receives a command to radially translate the rollers 21, 22 toward or away from the spin axis 25, actuator 80 extends or retracts the rod 81, which causes the hollow shaft 71 to axially translate accordingly. When the rod 81 extends away from the case 95, the hollow shaft 71 translates away from the case 95, causing the toothed portion 63 of hollow shaft 71 to rotate gears 61, 65 clockwise and counterclockwise, respectively. The rotation of gears 61, 65 that are meshed with the racks 62, 66 causes the bearing blocks 41, 42 and rollers 21, 22 to translate radially outward.

Alternatively, when the actuator 80 translates the rod 81 toward the case 95, the toothed portion 63 of the hollow shaft 71 causes the gears 61, 65 to rotate counterclockwise and clockwise, respectively, translating the bearing blocks 41, 42 and rollers 21, 22 radially inward.

Drive shaft 104 extends through and rotates relative to hollow shaft 71, which permits the shaft 71 to radially position the rollers 21, 22 while the carrier 50 is spinning. In the present embodiment, the radial drive mechanism 60 is referred to as an external actuation device, as the location of the hollow shaft 71, as the means for actuating the rollers, is located external to the drive shaft 104.

An axial drive mechanism 90 includes an actuator 91 fixedly secured to the machine base 89. A rod 92 extends from the actuator 91 and connects to the case 95 via a connector 93. The case 95 is translatable with respect to the machine base 89 along the spin axis 25. When the apparatus 20 requires the rollers 21, 22 to move along the spin axis 25, actuator 91 extends or retracts rod 92 to translate the case 95 and rollers 21, 22.

The axial drive mechanism 90 reciprocates the rollers 21, 22 along the spin axis 25 to sequentially engage roller 21 and then roller 22 to the workpiece 15. Alternatively, the axial drive mechanism 90 may be employed to reciprocate the workpiece 15 instead of the rollers 21, 22.

Apparatus 20 may include a controller (not shown) that is coupled to the apparatus 20 to provide control signals for spin forming a workpiece 15. As such, a controller may be coupled to the rotational drive mechanism 100, axial drive mechanism 90 and radial drive mechanism 60.

The present invention creates a formed portion 17 by spin forming a portion 16 (shown in phantom) of the workpiece 15. The spin forming operation begins by providing a workpiece 15 to the apparatus 20 and is complete when a portion to be formed 16 of the workpiece 15 is reduced to the desired diameter. Although a formed portion 17, as shown, is substantially conical, other shapes may be formed by the apparatus and method of the present invention, including a substantially cylindrical formed portion. The apparatus 20 of the present invention may create a formed portion 17 of a workpiece 15 during a forming operation on a single apparatus 20.

In the preferred embodiment, the rotational drive mechanism 100 is constantly spinning the carrier 50 about a spin axis 25 during the forming operation. The forming operation is more efficient if the carrier 50 is spinning continuously rather than stopping and starting. The time to complete a forming operation is thus reduced by providing a radial drive mechanism 60 that adjusts the rollers 21, 22 while the carrier 50 is spinning.

Before the axial drive mechanism 90 sequentially engages the rollers 21, 22 to the workpiece 15, the radial drive mechanism 60 is commanded to radially position the rollers 21, 22 for a forming pass. In the preferred embodiment, the rollers 21, 22 are translated in unison. A forming pass begins when the rollers 21, 22 contact the workpiece 15. The forming pass is complete when the rollers 21, 22 reach the desired location on the workpiece 15.

Prior to a first forming pass, radial drive mechanism 60 positions the first roller 21 to a first radial distance and the second roller 22 to a second radial distance, relative to the spin axis 25. The first radial distance is greater than the second radial distance. The axial drive mechanism 90 then translates the rollers 21, 22 or workpiece 15 from a first axial position to a second axial position, relative to the workpiece 15, to complete a forming pass. As the axial drive mechanism 90 translates the rollers 21, 22 along the spin axis 25, the diameter of the workpiece 15 is sequentially reduced until the rollers 21, 22 reach a desired location on the workpiece 15.

The axial drive mechanism 90 then translates the rollers 21, 22 or workpiece 15 to a first axial position. After the first forming pass, the radial drive mechanism 60 radially translates the first roller 21 from a first radial distance to a third radial distance, relative to the spin axis 25, where the first radial distance is greater than the third radial distance and the second roller 22 from a second radial distance to fourth radial distance, relative to the spin axis 25, where the second radial distance is greater than the fourth radial distance.

When a forming pass is complete, the radial drive mechanism 60 may translate the rollers 21, 22 away from the spin axis 25 to provide clearance between the rollers 21, 22 and workpiece 15 before the axial drive mechanism positions the rollers 21, 22 for a subsequent pass. The axial drive mechanism 90 reciprocates either the rollers 21, 22 or the workpiece 15 along the spin axis 25 by sequentially engaging roller 21 and then roller 22 to the workpiece and then retracting the rollers 21, 22 from the workpiece 15. Roller 21 and roller 22 sequentially reduce the diameter of a portion of the workpiece 15 during a forming pass. The axial drive mechanism 90 causes the first roller 21 to engage the workpiece 15 to reduce the diameter of the workpiece 15 from a first diameter to a second diameter and then engages the second roller 22 to the workpiece 15 to reduce the diameter of the workpiece from a second diameter to a third diameter. By sequentially reducing the workpiece 15, a higher reduction ratio is achieved. Thus, the present invention may reduce the diameter of a portion 16 of the workpiece 15 to achieve a desired diameter with a minimum number of passes.

The present invention has an improved reduction ratio over spin forming apparatus of the prior art. Each roller 21, 22 may be disposed to optimize the forming operation by maximizing the amount of reduction without causing the workpiece 15 to collapse. Furthermore, additional rollers may be operatively supported on carrier 50. As the number of rollers is increased, a higher reduction ratio may be achieved. It should be intuitive that if the radial offset among the rollers 21, 22 is constant, the amount of reduction possible in a single forming pass is a function of the number of rollers. In the preferred embodiment, the radial drive mechanism 60 translates rollers 21, 22 an equivalent radial distance.

Prior to a subsequent forming pass, the radial drive mechanism 60 positions the rollers 21, 22 to permit the rollers 21, 22 to further reduce the workpiece 15 when the axial drive mechanism 90 engages the rollers 21, 22 to the workpiece 15. The axial drive mechanism 90 continues to reciprocate the rollers 21, 22 or workpiece 15 while the radial drive mechanism 60 radially translates the rollers 21, 22 inwardly between forming passes until a desired reduction in diameter is achieved.

The axial drive mechanism 90 reciprocates the rollers 21, 22 or workpiece 15 to execute a plurality of forming passes. After completing a forming pass, the axial drive mechanism 90 positions the rollers 21, 22 to prepare for the next forming pass or to provide clearance for the workpiece 15 to be removed from the apparatus 20. The radial drive mechanism 60 may be controlled to translate the rollers 21, 22 inwardly in calculated steps. For example, the rollers 21, 22 may be radially translated in a very small increment to perform a finishing pass on the workpiece 15.

In operation, the present invention for spin forming a portion 16 of a workpiece 15 spins at least the first roller 21 and second roller 22 about the spin axis 25 where the first roller 21 is radially and axially offset the second roller 22. The first roller 21 and second roller 22 are commanded to translate radially to position the rollers 21, 22 for a forming pass. A forming pass is then commanded, wherein one of either the rollers 21, 22 or workpiece 15 travel along the spin axis 25 to engage the first roller 21 and then the second roller 22 to the workpiece 15 to sequentially reduce the diameter of a portion of the workpiece to create a formed portion 17. If an end portion is being process, then the rollers 21, 22 may engage an end of the workpiece 15. The diameter of a portion 16 of the workpiece 15 is sequentially reduced until a desired diameter is achieved, permitting a portion of the workpiece to be reduced from an original diameter to a final diameter on a single apparatus. A plurality of forming passes may be commanded to sequentially reduce the diameter of the portion 16 of the workpiece 15 during a forming operation.

The apparatus 20 executes a plurality of cycles during a forming operation. Each cycle begins with the axial drive mechanism 90 positioning the rollers 21, 22 at a first axial position, relative to the workpiece 15, and the radial drive mechanism 60 radially positioning the rollers 21, 22, relative to the spin axis 25, for a forming pass. The axial drive mechanism then engages the first roller 21 and then the second roller 22 to the workpiece 15, causing the rollers 21, 22 to travel along the workpiece, sequentially reducing the diameter, until the forming pass is complete. The axial drive mechanism then retracts the rollers 21, 22, causing the rollers 21, 22 to move along the spin axis 25 in the opposite direction to prepare for the next cycle or to remove the workpiece 15.

Figure 7:
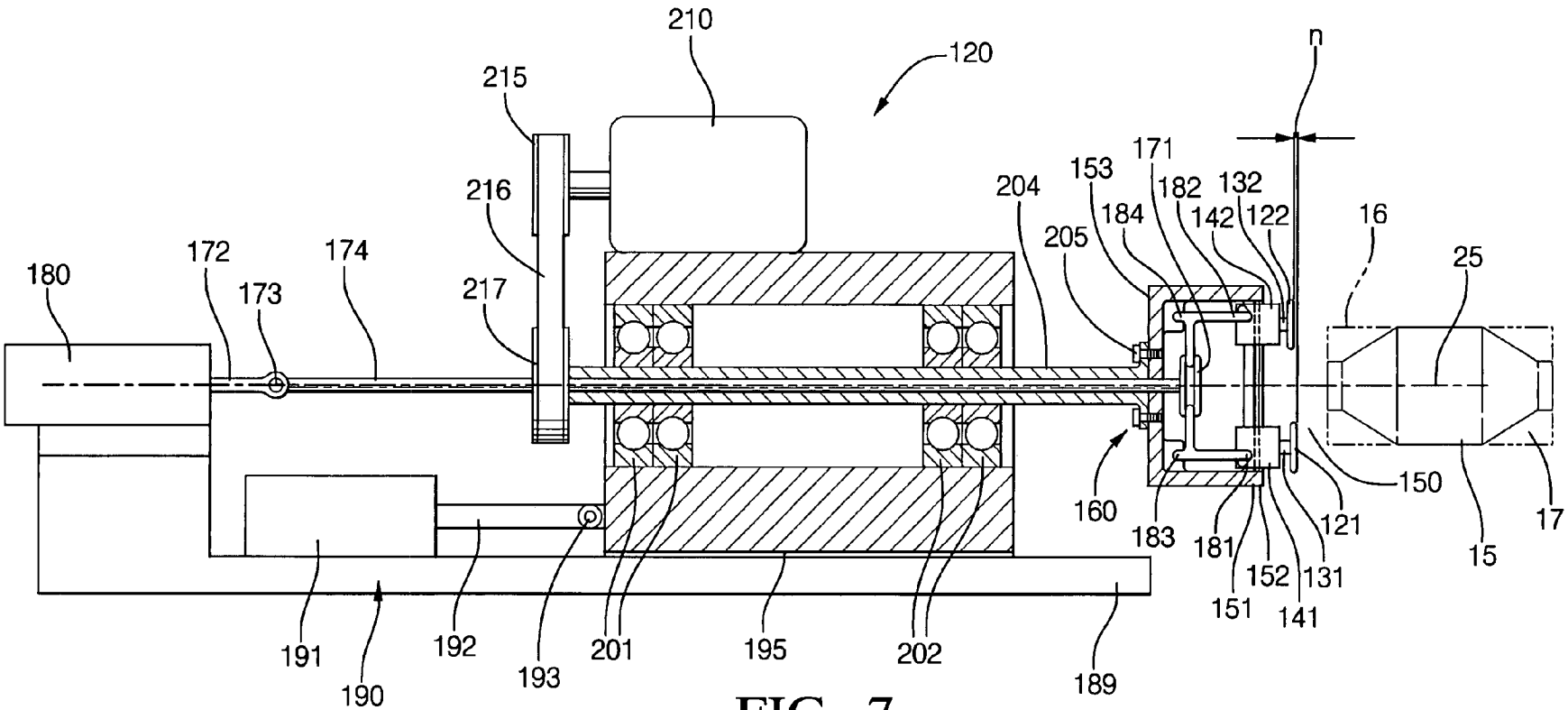
FIG. 7 is a side view of a second embodiment of the spin forming apparatus according to the principles of the present invention, having a portion thereof sectioned.

Referring now to FIG. 7, a side view of a second embodiment of a spin forming apparatus 120 according to the principles of the present invention is shown. A rotational drive mechanism 200 comprises a drive shaft 204 rotatably supported in a housing block or case 195 by a first pair of bearing elements 201 and a second pair of bearing elements 202. The case 195 is slidably supported on a machine base 189. A motor 210 is fixedly mounted to the case 195. A pulley 215 is operatively coupled to an output shaft rotatably driven by the motor 210. Pulley 215 drives a belt 216 that rotates a pulley 217. Pulley 217 is operatively coupled to drive shaft 204. Also attached to drive shaft 204 is a carrier 150. Carrier 150 includes a carrier housing 153 and faceplate 152. The faceplate 152 has at least two radially extending channels 151.

A radial drive mechanism 160 includes an actuator 180 fixedly secured to machine base 189. A rod 174 extending from actuator 180 is coupled to a shaft 172 by a connector 173. The rod 174 extends through the hollow drive shaft 204. A yoke 171 is fixedly secured to the shaft 172. A pair of levers 181, 182 are pivotally attached to carrier 150 by pins 183, 184. A first bearing block 141 and second bearing block 142 are each disposed in one of the radially extending channels 151. A first roller 121 and second roller 122 are operatively supported on the carrier 150 by shafts 131, 132 extending from bearing blocks 141, 142, respectively. The first roller 121 is radially and axially offset from the second roller 122. The rollers 121, 122 are radially movable toward away from the spin axis 25. The levers 181, 182 engage bearing blocks 141 and 142. When the actuator 180 retracts the shaft 172, levers 181, 182 cause the bearing blocks 141, 142 and the attached rollers 121, 122 to translate radially inward.

Hollow drive shaft 204 rotates with respect to shaft 172, which permits the radial drive mechanism 160 to translate the rollers 121, 122 while the rollers 121, 122 are spinning. In the present embodiment, the radial drive mechanism 160 is referred to as an internal actuation device, as shaft 172 is internal to hollow drive shaft 204. Furthermore, shaft 172 may retract, extend or move along with hollow drive shaft 204. An axial drive mechanism 190 includes an actuator 191 that is fixedly secured to machine base 189. A rod 192 extends from actuator 191 and is coupled to the slidably supported case 195 by a connector 193.

Figure 8:
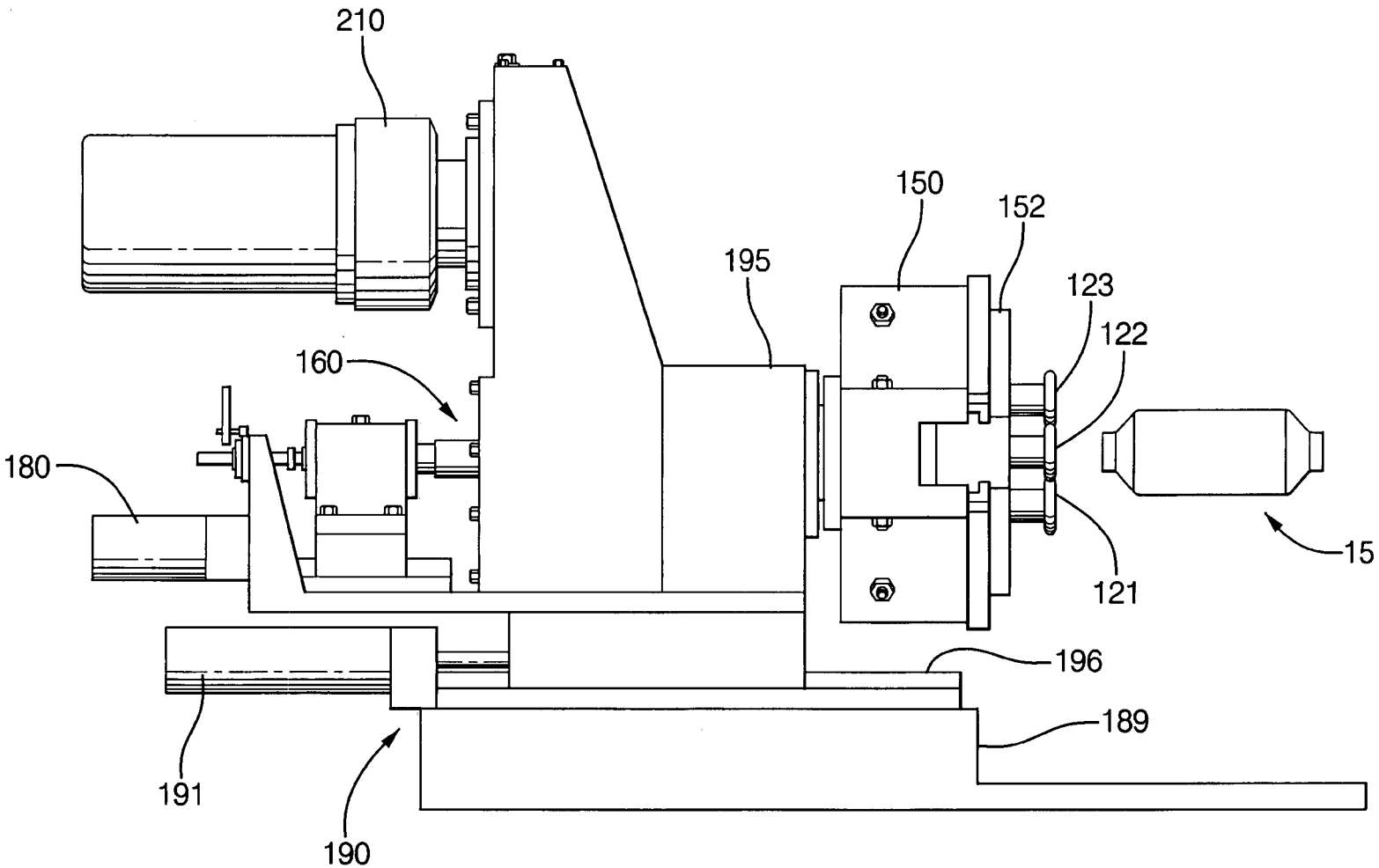
FIG. 8 is a side view of another embodiment of the spin forming apparatus according to the principles of the present invention.

Referring now to FIG. 8, a side view of another embodiment of the spin forming apparatus 120 according to the principles of the present invention includes actuator 180 fixedly secured to the case 195. The case 195 is slidably disposed on the machine base 189, guided by ways 196. In the present embodiment three rollers 121, 122, 123 are operatively supported by the carrier 150.

Figure 9:
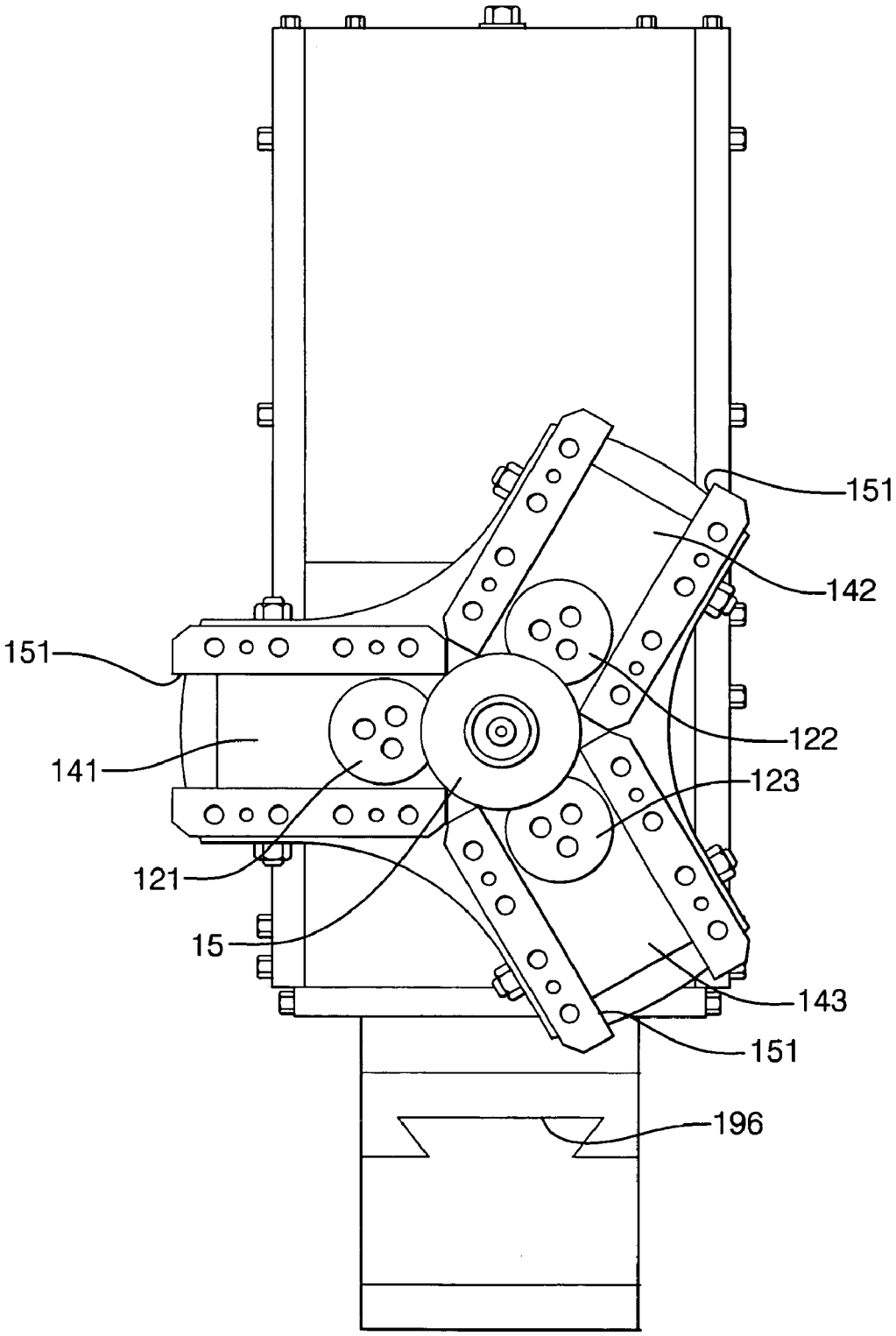
FIG. 9 is a front view of the spin forming apparatus of FIG. 8.

Referring now to FIG. 9, a front view of the spin forming apparatus 120 of FIG. 8 reveals the carrier 150 in greater detail. The bearing blocks 141, 142, 143 are slidably supported within the channels 151 disposed in carrier 150.

Figure 10:
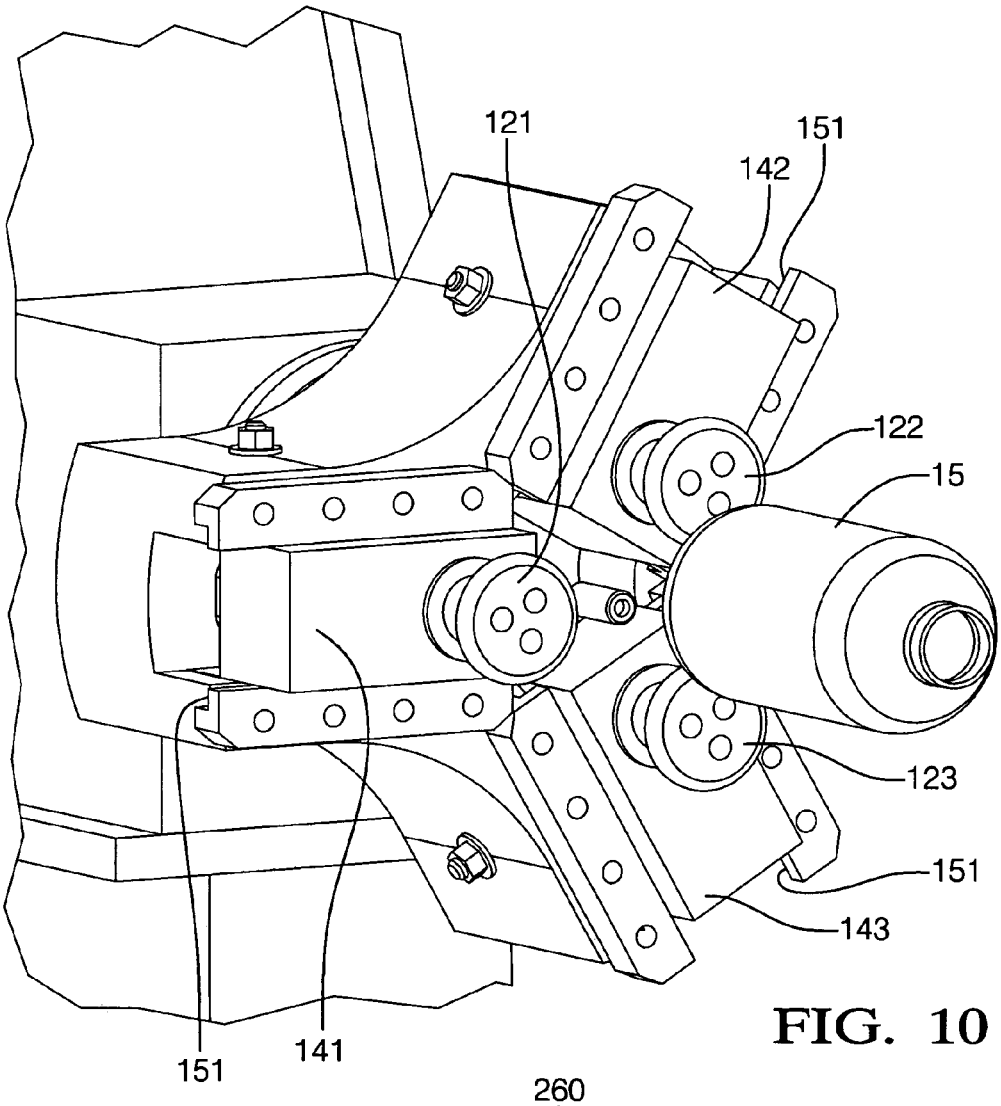
FIG. 10 is an enlarged partial perspective view of the spin forming apparatus of FIG. 8.

Referring now also to FIG. 10, an enlarged partial perspective view of the spin forming apparatus 120 of FIG. 8 more clearly reveals the mounting scheme for the rollers 121, 122, 123. Rollers 121, 122, 123 are each fixedly secured to bearing blocks 141, 142, 143, respectively. Each of the bearing blocks 141, 142, 143 radially translate within one of the plurality of radially extending channels 151.

Figure 12:
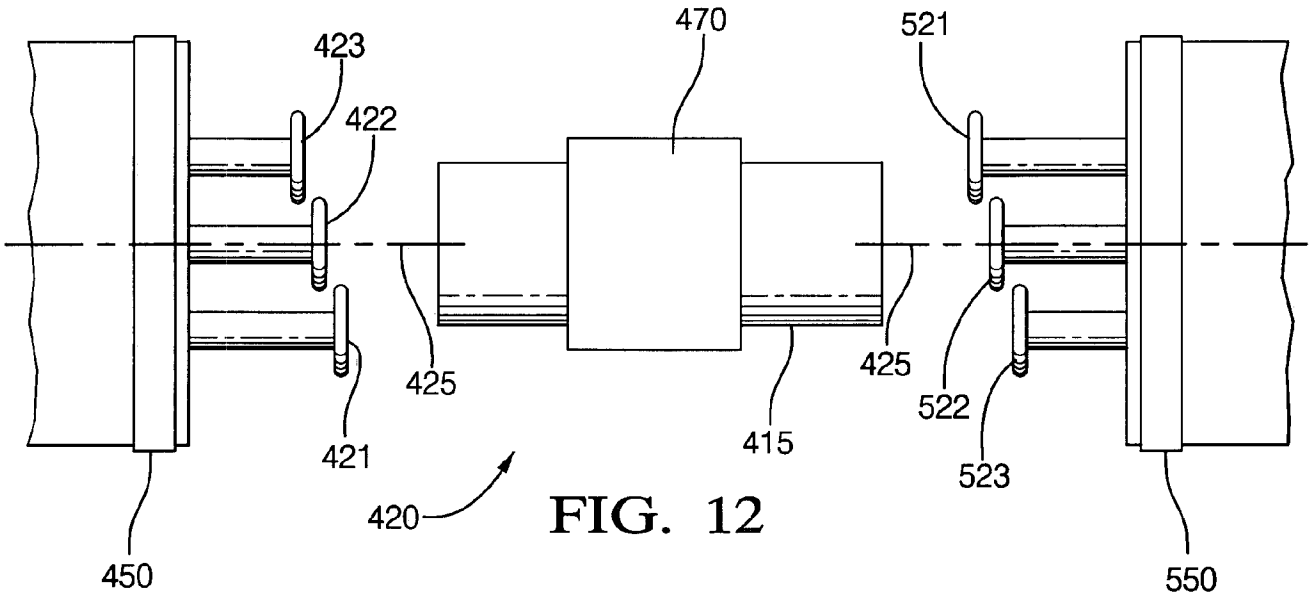
FIG. 12 is another embodiment of the present invention, disclosing two carriers and two sets of rollers for forming both ends of the workpiece.

Referring now also to FIG. 12, another embodiment of a spin forming apparatus 420 according to the principles of the present invention is shown. Apparatus 420 comprises a first carrier 450 and second carrier 550. First carrier 450 has a plurality of rollers 421, 422, 423 operatively supported thereon and second carrier 550 has a plurality of rollers 521, 522, 523 operatively supported thereon. Each of the rollers 421, 422, 423 is radially and axially offset from the other rollers. For example, roller 421 is disposed the greatest axial distance of the three rollers from the face of the carrier 450. Roller 421 is also disposed at the furthest radial distance from the spin axis 425. Roller 422 is disposed the next furthest axial distance from the face of the carrier 450 and is disposed the next furthest radial distance from the spin axis 425. Roller 423 is disposed at the shortest axial distance to the face of the carrier 450 and the shortest radial distance to the spin axis 425. Rollers 521, 522, 523 are arranged in a like manner.

A fixture 470 is provided to constrain workpiece 415. An axial drive mechanism may reciprocate one of the carriers 450, 550 or workpiece 415 along the spin axis. The carriers 450, 550 may cause the rollers 421, 422, 423, and rollers 521, 522, 523 to engage the workpiece 415 simultaneously or alternately. Alternatively, the axial drive mechanism may cause the workpiece to shuttle between the rollers 421, 422, 423 and rollers 521, 522, 523. Accordingly, the present embodiment of apparatus 420 may process both ends of the workpiece at the same time or during the same forming operation.

Referring now to FIGS. 11*a* through 11*d*, plan and side views of another embodiment of a spin forming apparatus 220 according to the principles of the present invention is shown. A carrier 250 is rotatable about a spin axis 225, having a plurality of rollers 221, 222, 223 operatively supported thereon. Each roller is radially and axially offset from the other rollers. The rollers 221, 222, 223 are radially movable toward and away from the spin axis 225.

The spin forming apparatus 220 in the present embodiment comprises a pivoting mechanism 260 for rotating a workpiece 315 about a pivot point 230. It is within the scope of the present invention that the pivoting mechanism 260 may rotate carrier 250 instead of or in conjunction with the workpiece 315.

Figure 13:
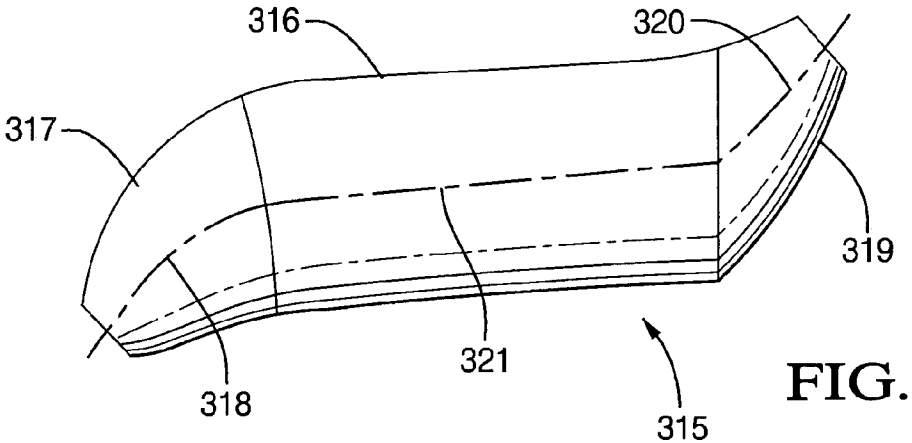
FIG. 13 is an illustration of a workpiece formed by the present invention, with examples of possible formed portions on each end of the workpiece and axes therefore.

Referring now also to FIG. 13, an illustration of the workpiece 315 formed by the exemplary embodiment of the present invention reveals example formed portions and axes thereof on each end of the workpiece 315. Workpiece 315 has a non-processed portion 316 and a non-processed axis 321. At a first end of workpiece 315 is a substantially curved first processed portion 317 having a non-linear formed axis 318. At a second end of workpiece 315 is a substantially oblique processed portion 319 having a linear formed axis 320. Each formed axis 318, 320 is non-coaxial with the non-processed axis 321.

Figure 11A:
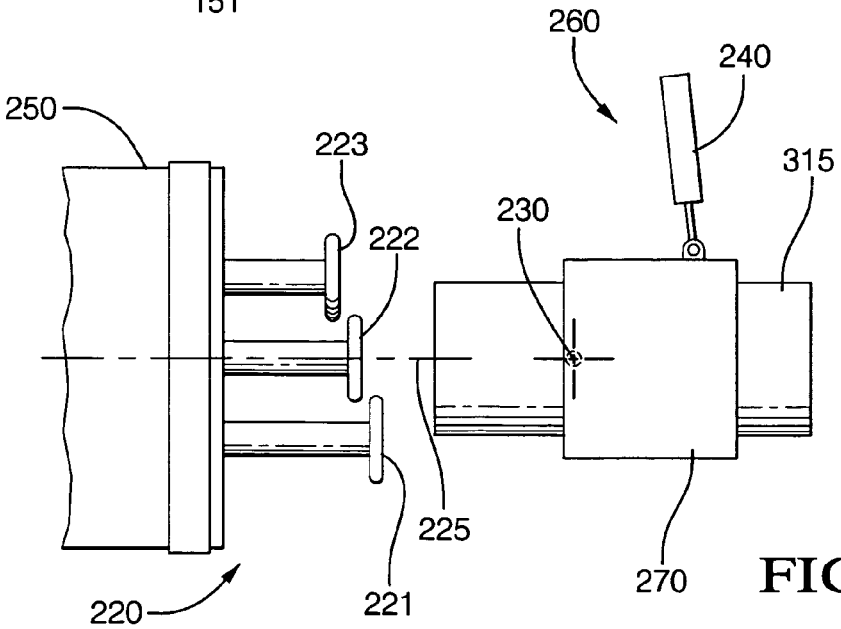
FIGS. 11*a* through 11*d* are plan and side views of another embodiment of the present invention, further including a fixture and device for pivoting the workpiece, showing the workpiece before and after forming.

FIG. 11*a* is a plan view of the apparatus 220, revealing an unprocessed workpiece 315 constrained by a fixture 270. The fixture 270 is shown oriented at first angular position where the axis 321 of the unprocessed workpiece 315 is aligned with the spin axis 225. In the present embodiment, the pivoting mechanism 260 includes an actuator 240 pivotally attached to a fixture 270 for rotating the fixture 270 about the pivot point 230. In the preferred embodiment, the actuator 240 is a programmable actuator. During a forming operation, the pivoting mechanism 260 positions the workpiece 315 as required by rotating the workpiece 315 about the pivot point 230 to create a formed axis that is non-coaxial with the axis of the non-processed portion 316 of a workpiece 315.

Figure 11B:
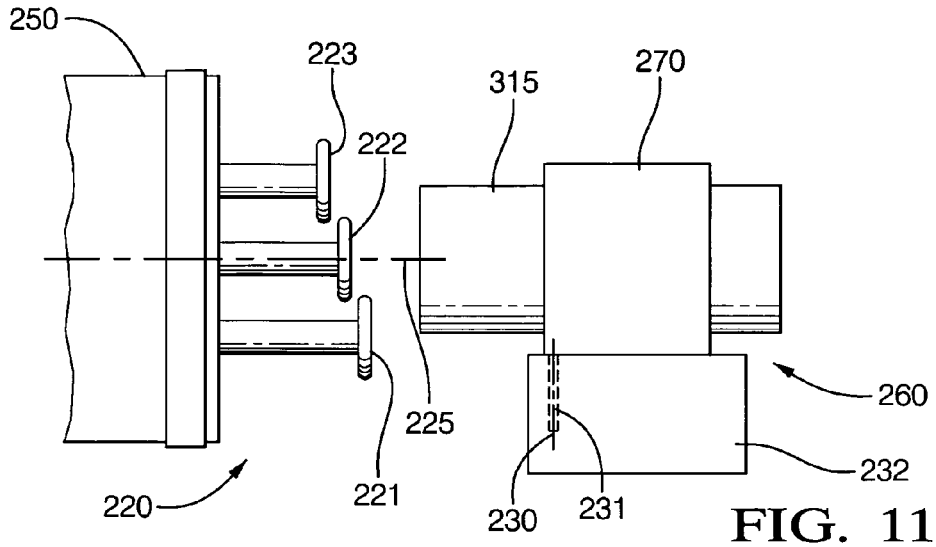

FIG. 11*b* is a side view of the apparatus 220, with the unprocessed workpiece 315 secured in the fixture 270. The fixture 270 is pivotally mounted on the base 232 and rotates about a pivot point 230. A pivot pin 231 is provided within the base 232 to locate the fixture 270 for rotation about the pivot point 230. Although a pin 231 is shown, any suitable substitute known in the art may be employed to permit relative rotation about a pivot point including shafts, bearings, bushings and the like. In the present embodiment, the pivot point 230 is fixed relative to the workpiece 315; however, it is within the scope of the present invention that the relative location of the pivot point may be movable.

Figure 11C:
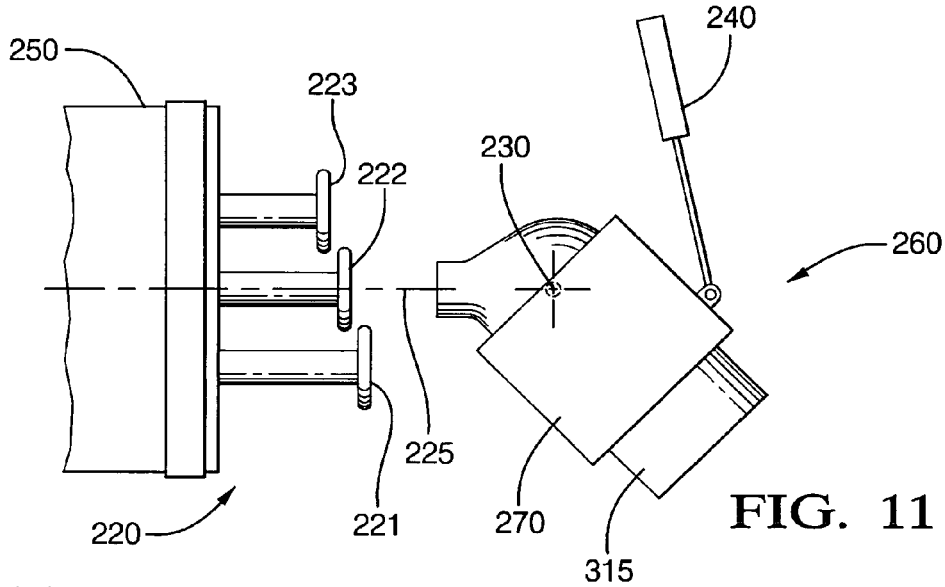

FIG. 11*c* is a plan view of the apparatus 220, revealing a processed workpiece 315 constrained by a fixture 270. The fixture 270 is shown oriented at a final angular position where the axis 321 of the unprocessed portion of the workpiece 315 is positioned at an oblique angle relative to the spin axis 225. The processed end of the workpiece 315 has a substantially curved or "snorkel" shape, which enhances flow characteristics.

Figure 11D:
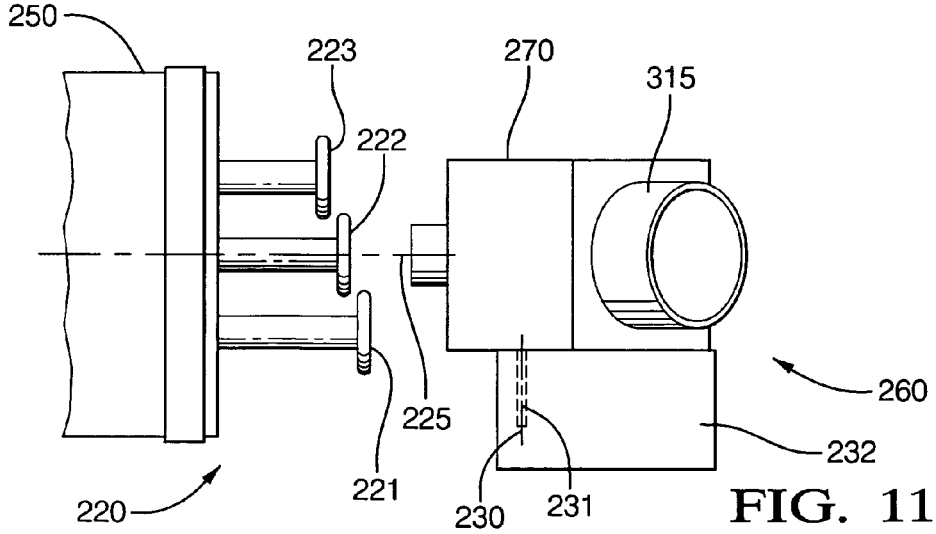

FIG. 11*d* is a side view of the apparatus 220, with the processed workpiece 315 secured in the fixture 270, shown oriented at a final angular position. In operation, the pivoting mechanism 260 rotates either the carrier 250 or workpiece 315 about the pivot point 230, from a first angler position to a second angular position, during a forming operation to create a formed axis 318 that is non-coaxial with the non-processed axis 321 of the workpiece 315. The pivoting mechanism 260 may cause the carrier 250 or the workpiece 315 to rotate several times during a forming operation, preferably between forming passes. In the preferred embodiment, a programmable controller (not shown) is operatively coupled to the radial drive mechanism, the pivoting mechanism 260 and the radial drive mechanism to govern the forming operation. In the present embodiment, the carrier 250 or workpiece 315 pivot within a plane containing the spin axis 225.

The instant embodiment of the spin forming apparatus 220 of present invention spin forms a portion of the workpiece 315 where the formed portions 317, 319 have formed axes 318, 320 respectively, that are non-coaxial with the axis 321 of a non-processed portion 316 of the workpiece 315. The workpiece 315 is formed by spinning at the rollers 221, 222, 223 about the spin axis 225, where each roller 221, 222, 223 is radially and axially offset from the others. The rollers 221, 222, 223 are commanded to translate radially toward and away from the spin axis to position the rollers 221, 222, 223 for forming pass. The rollers 221, 222, 223 or workpiece 315 are rotated about a pivot point 230 from a first angular position to second angular position during forming operation. A forming pass is commanded where either the rollers 221, 222, 223 or workpiece 315 travel along the spin axis 225 to engage the first roller 221 and then the second roller 222 and then lastly the third roller 223 to the workpiece 315 to sequentially reduce the diameter of portion 317 of the workpiece 315 to create a formed portion 317 having a formed axis 318 that is non-coaxial with a non-processed axis 321 of the workpiece 315.

Formed portion 317 is referenced for exemplary purposes, however it should be understood that formed portion 317 represents a generic formed portion having a formed axis that is non-coaxial with the non-processed axis of the workpiece 315 and is not to be interpreted as limiting in any way. Quite the contrary, various shapes may be formed by the process and apparatus of the instant embodiment of the present invention. The angular position of the workpiece 315 or rollers 221, 222, 223 may change more than once during a forming operation. In the preferred embodiment, one of the rollers 221, 222, 223 or workpiece 315 is rotated about a pivot point 230 prior to a subsequent forming pass. In the present embodiment, one of the rollers 221, 222, 223 or workpiece 315 is rotated about the pivot point within a plane containing the spin axis 225. The pivoting of the rollers 221, 222, 223 or workpiece 315 may be controlled to form a substantially curved portion. To form a substantially curved portion, the rollers 221, 222, 223 or workpiece 315 is rotated about a pivot point 230 to multiple angular positions during a forming operation.

The foregoing discussion discloses and describes the preferred structure and control system for the present invention. However, one skilled in the art will readily recognize from such discussion, and from the accompanying drawings and claims, that various changes, modifications and variations can be made therein without departing from the true spirit and fair scope of the invention as defined in the following claims.

What is claimed is:

1. An apparatus for spin forming a portion of a workpiece, comprising:

a carrier rotatable about a spin axis;

at least a first roller and a second roller operatively supported on said carrier, said first roller being radially and axially offset from said second roller, said first and second rollers radially movable toward and away from the spin axis;

a rotational drive mechanism having an axial drive shaft for spinning said carrier about a spin axis;

a radial drive mechanism for radially translating said first roller and said second roller toward and away from the spin axis to position said rollers for a forming pass, wherein said radial drive mechanism further comprising:

a shaft supported coaxially by said axial drive shaft, radially inboard of said first and second rollers, for guided movement along said spin axis;

an actuator for moving said shaft along said drive shaft coaxial to said spin axis; and a translation mechanism operable between said shaft and rollers for translating the axial motion of said shaft into radial motion of said rollers; and an axial drive mechanism for reciprocating one of said first and second rollers or workpiece along a spin axis to sequentially engage said first roller and then said second roller to the workpiece where said first roller and said second roller sequentially reduce the diameter of a portion of the workpiece during a forming pass.

2. The apparatus of claim 1, wherein said axial drive mechanism continues to reciprocate until a desired reduction in diameter is achieved.

3. The apparatus of claim 1, wherein said radial drive mechanism translates said rollers in unison.

4. The apparatus of claim 1, wherein said first roller and said second roller sequentially reduce the diameter of a portion of the workpiece to achieve a desired diameter with a minimum number of forming passes.

5. The apparatus of claim 1, wherein said radial drive mechanism positions said first and second rollers before said axial drive mechanism sequentially engages said first roller and then said second roller to a first end of the workpiece.

6. The apparatus of claim 5, wherein said radial drive mechanism causes said first roller and said second roller to radially translate inward by an equivalent radial distance prior to a subsequent forming pass.

7. The apparatus of claim 1, wherein said first roller reduces the diameter of a portion of the workpiece from a first diameter to a second diameter and said second roller reduces the diameter of a portion of the workpiece from a second diameter to a third diameter.

8. The apparatus of claim 1, wherein said rollers translate inwardly in calculated steps.

9. The apparatus of claim 7, wherein the change in diameter between the first diameter and second diameter is about equivalent to the change in diameter between the second diameter and third diameter.

10. The apparatus of claim 5, wherein after a first forming pass, said radial drive mechanism radially translates said first roller from a first radial distance to a third radial distance, relative to the spin axis, where the first radial distance is greater than the third radial distance, and said second roller from a second radial distance to a fourth radial distance, relative to the spin axis, where the second radial distance is greater than the fourth radial distance.

11. The apparatus of claim 1, wherein said axial drive mechanism reciprocates said rollers toward the workpiece.

12. The apparatus of claim 11, further comprising a fixture for constraining the workpiece.

13. The apparatus of claim 1, wherein said radial mechanism is an external actuation device.

14. The apparatus of claim 1, wherein said radial drive mechanism is an internal actuation device.

15. The apparatus of claim 1, wherein said radial drive mechanism is operable to translate said first roller and said second roller while said rotational drive mechanism is spinning said carrier.

16. The apparatus of claim 1, wherein the amount of reduction in a single forming pass is a function of the number of rollers.

17. The apparatus of claim 1, wherein the portion of the work piece is reduced from an original diameter to a final diameter on a single apparatus.

18. The apparatus of claim 1, wherein the number of forming passes to achieve a desired reduction in diameter during a forming operation is a factor of about the number of rollers.

19. The spin forming apparatus of claim 12, wherein the axis of the non-processed portion of the workpiece is at an oblique angle relative to the spin axis.

* * * * *